United States Patent [19]

Bamburg et al.

[11] 4,272,009

[45] Jun. 9, 1981

[54] ONE-PIECE DOUBLE DEPTH SHIPPING CONTAINER

[75] Inventors: Robert A. Bamburg, Hebert; Farris N. Duncan, West Monroe; Roger M. Floyd, Monroe, all of La.

[73] Assignee: Manville Forest Products, Dover, Del.

[21] Appl. No.: 89,849

[22] Filed: Oct. 31, 1979

[51] Int. Cl.[3] ..... B65D 5/08; B65D 5/00

[52] U.S. Cl. ..... 229/41 R; 229/41 B; 229/23 BT

[58] Field of Search ..... 229/41 R, 41 B, 23 BT; 206/600; 220/468

[56] References Cited

U.S. PATENT DOCUMENTS

| | | | |
|---|---|---|---|
| 3,176,904 | 4/1965 | Collura | 229/41 B X |
| 3,438,562 | 4/1969 | Connor et al. | 229/41 R X |
| 3,502,488 | 3/1970 | Bridgford | 229/36 X |
| 3,565,325 | 2/1971 | Pugsley | 229/41 B X |
| 3,727,824 | 4/1973 | Giegel | 229/41 B X |
| 3,917,154 | 11/1975 | Dove | 229/41 R X |
| 4,014,292 | 3/1977 | Coughlin | 229/41 R X |
| 4,085,847 | 4/1978 | Jacalone | 229/23 BT X |
| 4,101,052 | 7/1978 | Dove | 229/41 R X |

*Primary Examiner*—Davis T. Moorhead

*Attorney, Agent, or Firm*—Robert M. Krone; Joseph J. Kelly; Norvell E. Von Behren

[57] ABSTRACT

A shipping container is disclosed which allows the user to ship two levels of product in the container. The first level is available when the container is folded to a first compact use size while the second level is available when the container is folded to a second expanded use size.

9 Claims, 14 Drawing Figures

Fig. 4
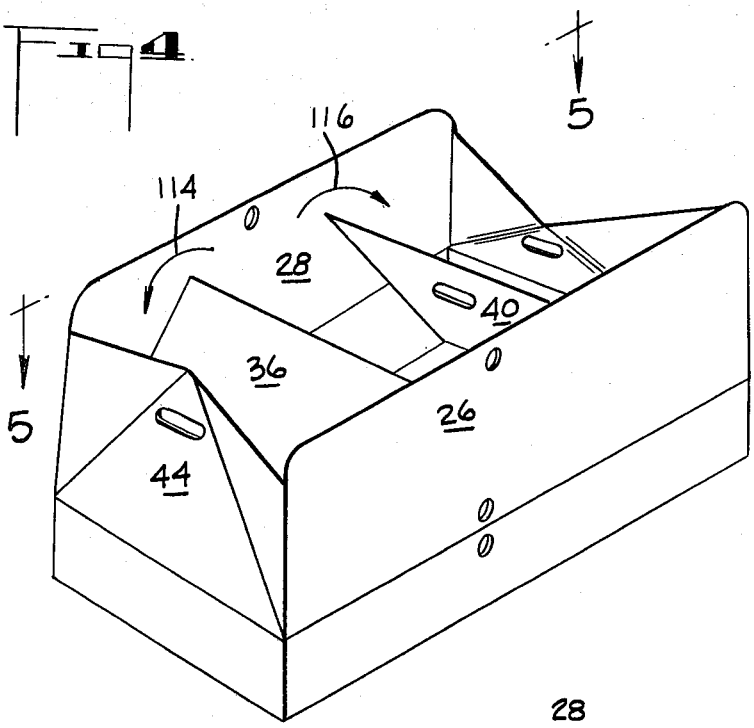
Fig. 9
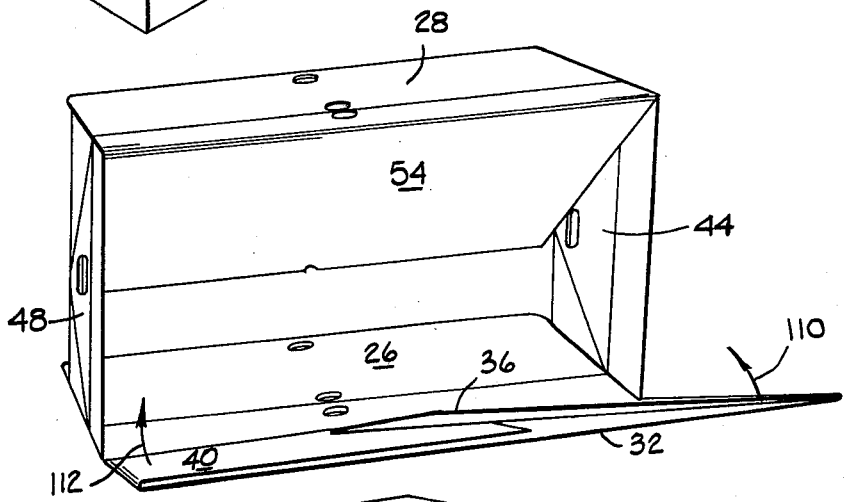
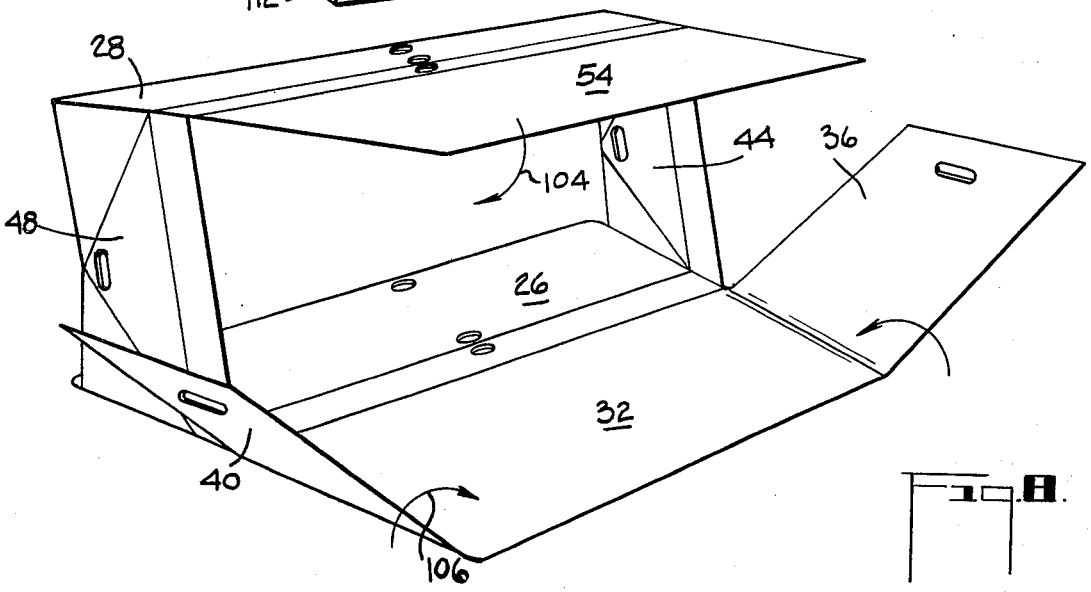
Fig. 8

FIG. 7.
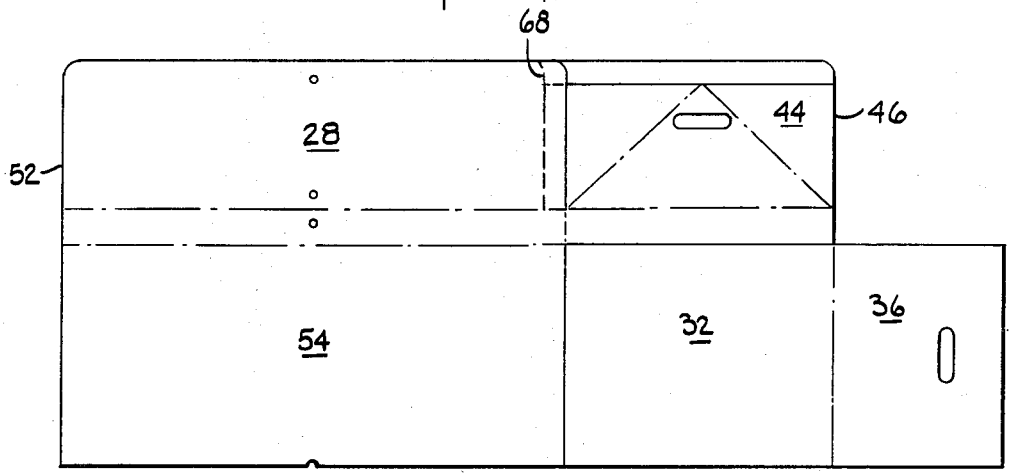
FIG. 10.
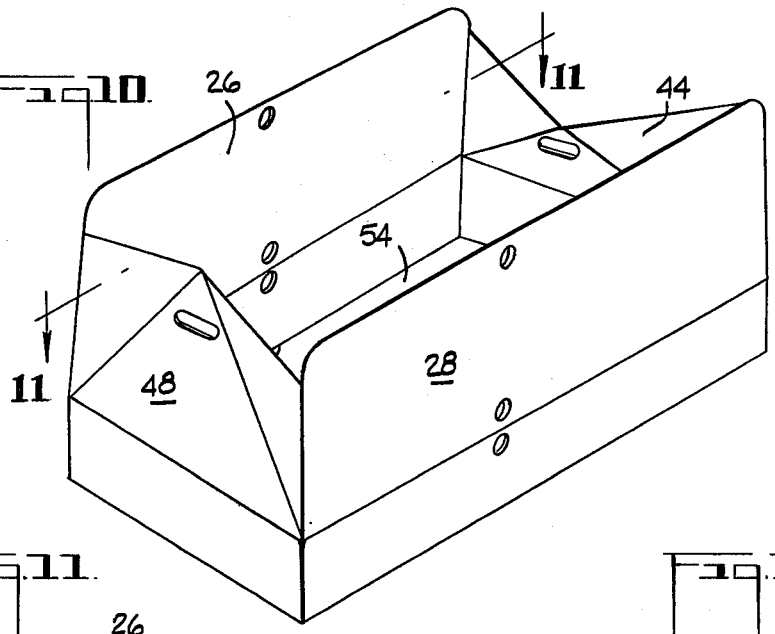
FIG. 11.
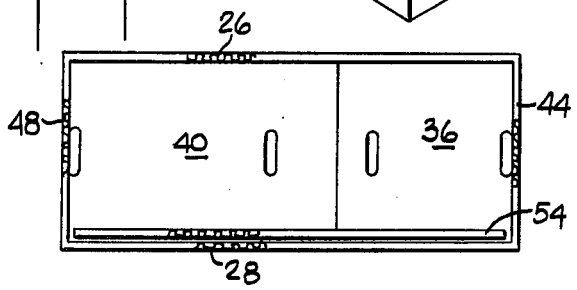
FIG. 13.
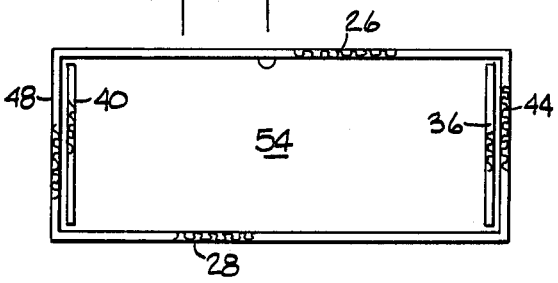
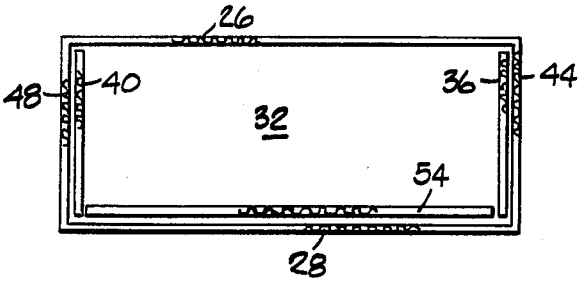
FIG. 12.

ONE-PIECE DOUBLE DEPTH SHIPPING CONTAINER

BACKGROUND OF THE INVENTION

This invention relates generally to shipping containers and more specifically to a double depth shipping container that may be folded into one of two positions to provide a one-piece multiple size container.

In the manufacture and sale of clothing, it is known to manufacture the various parts of a unit of clothing either at separate locations or by separate companies. For example, in the manufacture of a two-piece set of children's clothes, the pants may be manufactured in one building and the shirt may be manufactured in another building. When this occurs, it is desirable to fill a shipping container at the first location with the childrens pants and to transport the container to the second location where the childrens shirts are added to the container. Thereafter the entire container would be shipped to a final destination where the two-piece combinations may be assembled or sold separately as desired.

It is for this purpose that the subject invention was designed in order to eliminate the use of separate containers required for the separate shipping stations and also to provide a single one-piece shipping container that may be foldable into multiple sizes of containers.

It is also desirable in other industries such as the plastics industries to have available a container in which the basic raw material such as sheets of plastic may be shipped in a container to a fabrication site. At the fabrication site the container may be unloaded and the parts fabricated and reloaded into the same container which could be opened to a larger or extended size. Until the applicants' invention was completed, this was not possible with a one-piece container and either a two-piece container was required or several size containers had to be utilized resulting in additional packaging cost being passed onto the ultimate customer.

It is known in the packaging art to provide shipping containers which are foldable from a collapsed or non-use position to an extended usable position. Such a container is shown in the U.S. Pat. No. 4,085,847, issued Apr. 25, 1978 to Richard P. Jacalone and assigned to Olinkraft Inc. In the cited reference a top and bottom cap are foldable over a collapsed tube assembly and other parts for purposes of shipping the pack to the customer. Upon receipt of the pack, the container is assembled to the usable position shown in FIG. 7 of the drawing and is filled with a desired quantity of product. The container shown in the cited patent is not usable in its collapsed non-use position other than as a shipping container for the respective parts of the package as can be seen by referring to FIG. 2 of the drawing.

It is also known in the prior art to provide a two-piece shipping container as shown in the U.S. Pat. No. 3,438,562, issued Apr. 15, 1969 to William G. Connor et al. and assigned to Inter Store Transfer Specialists Inc. By a two-piece container the applicants are herein referring to the body structure of the container and are not referring to the top cap feature of the container which is used in many containers of the type described. In the cited patent issued to Connor et al there is taught also a container which is foldable from a collapsed or non-use position to an extended usable position with the use of an inner liner 30 as shown in FIG. 3 of the drawing. The container shown in this patent is designed for use in an expanded condition for the storage and transport of objects and is adapted to be collapsed for intermediate periods of non-use to a smaller size that when expanded. Such a container as shown as well as the previously described container shown in the U.S. Pat. No. 4,085,847 would not be usable in the packaging situations hereinbefore described wherein it is desirable to be able to have available a single one-piece container which is expandable from a usable compact position to a usable extended position as is provided for by the applicants' invention.

SUMMARY OF THE INVENTION

In order to alleviate the problems inherent in the prior art type of containers cited when these containers are utilized in the types of manufacturing process described, there has been provided by the applicants' invention a new and novel one-piece double depth shipping container which is foldable to either a first compact use position or to a second expanded use position thereby allowing the container to have multiple uses. By a one-piece container it is meant that the body of the container is made in a one-piece configuration and when the container is used with a top cap, the entire closed container structure would then be a two-piece container.

The applicants' new and novel double depth shipping container and production blank from which the container is manufactured comprises a body section that features a straight climax bottom which provides two thicknesses of material on the bottom whenever the container is folded into a second expanded use position. It also features a portion of a third thickness on the bottom of the container whenever the container is folded to a first compact use position. The end structure of the applicants' new and novel container is such that when the container is folded to a second extended use position, the ends of the container are double thickness. By the use of a bellows style top portion, the applicants' container may be quickly and easily folded from the first compact use position to the second expanded use position or vice versa as desired by the user of the package. When the top bellows portion is collapsed, the two inner end panels are folded inwardly and lie in juxtaposition to the inner bottom panel of the container.

When formed thusly, the applicants' new and novel container provides the customer with a more economical container than is presently being used and also provides increased product protection. In addition, it allows the customer to overpack the container with extra product to a bulging condition while still being able to utilize the container as a shipping package.

Accordingly it is an object and advantage of the invention to provide a one-piece double depth shipping container body which is foldable to either a first compact use position or to a second expanded use position.

Another object and advantage of the invention is to provide a one-piece double depth shipping container body production blank which may be formed into a one-piece shipping container that is quickly and easily folded from the first compact use position to the second expanded use position or visa versa.

These and other objects and advantages of the invention will become apparent from a review of the drawings and from a study of the hereinafter described description of the preferred embodiment.

BRIEF DESCRIPTION OF THE DRAWINGS

FIG. 4 is a perspective view of the container body shown in FIG. 3 showing the bellows style top portion opened up further and showing how the pair of inner end panels would be repositioned to a vertical position whenever the container is used in the second extended use position;

FIG. 7 is a plan view of the blank shown in FIG. 6 showing the container body being folded in the position where the manufacturers joint can be formed;

FIG. 8 is a perspective view looking at the bottom of the container as the folded container body of FIG. 7 would appear prior to the folding of the bottom and inner end panels for the setting up of the container;

FIG. 9 is a perspective view looking in at the bottom of the container body showing the folding of the pair of inner end panels and the outer bottom panel of the applicants' invention;

FIG. 10 is a perspective view looking at the top of the container and showing the position of the inner bottom panel as the container is folded from the position shown in FIG. 9;

FIG. 11 is a plan view taken along lines 11—11 of FIG. 10 showing the inner bottom panel raised up as the folding of the bottom is being completed;

FIG. 12 is a plan view taken along lines 11—11 of FIG. 10 further showing the folding of the bottom with the inner end panels being shown folded up;

FIG. 13 is a plan view taken along lines 11—11 of FIG. 10 further showing the folding of the bottom with the inner bottom panel now being shown folded down to the position occupied whenever the container is used in the first compact position.

DESCRIPTION OF THE PREFERRED EMBODIMENT

Figure 1:
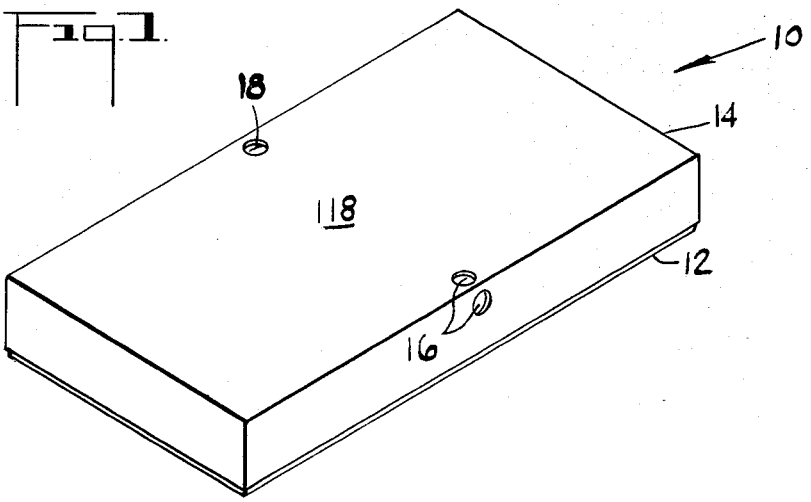
FIG. 1 is a perspective view of the applicants' new and novel shipping container shown folded to the first compact use position with a top cap applied thereto.
Figure 2:
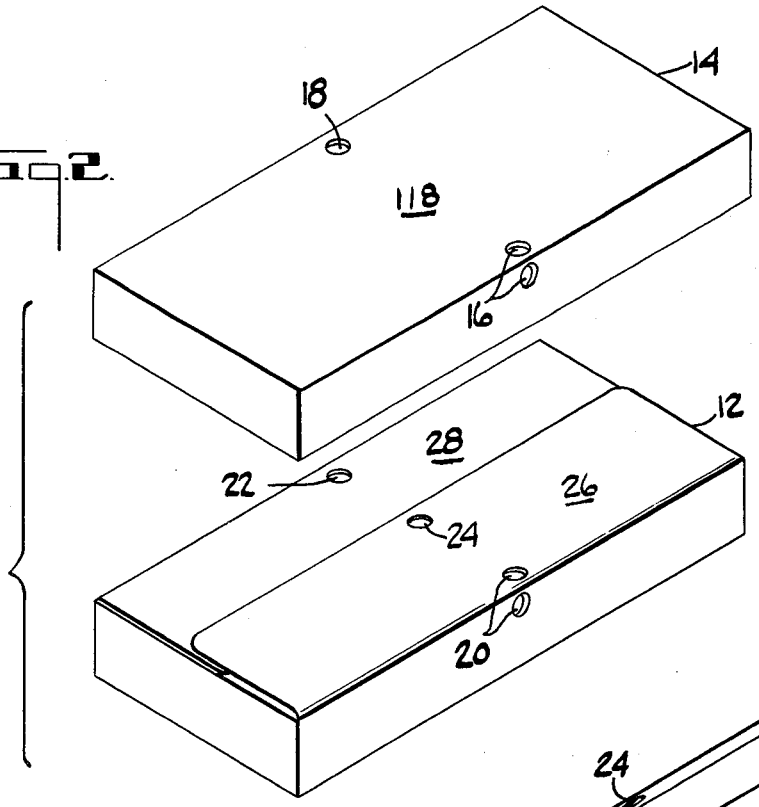
FIG. 2 is a perspective view of the shipping container shown in FIG. 1 showing the top cap of the container removed from the body of the container.

Referring now to the drawings in general and in particular to FIGS. 1 and 2 of the drawings there is shown the applicants' shipping container generally by the numeral 10. The shipping container 10 comprises a generally one-piece container body 12 and may also have positioned thereupon a generally one-piece top cap 14. The top cap 14 also has formed therein a plurality of holes 16 located along one side of the top cap. There is also formed a plurality of holes 18 located along the other side of the top cap. The one-piece body 12 also has formed therein a plurality of holes 20 along one side of the body as well as a plurality of holes 22 along the opposite side of the body. The holes 16 are positioned to be aligned with the holes 20 while the holes 18 are positioned to be aligned with the holes 22 whenever the top cap 14 is placed over the body 12 as shown in FIG. 1 of the drawing. When in this position a banding strap, not shown in the drawing, may be positioned through the plurality of holes in order to lock the top cap 14 onto the body 12. The banding strap may be then used to rigidly secure the top cap 14 to the body 12 and also to prevent pilferage of the contents of the package.

Figure 3:
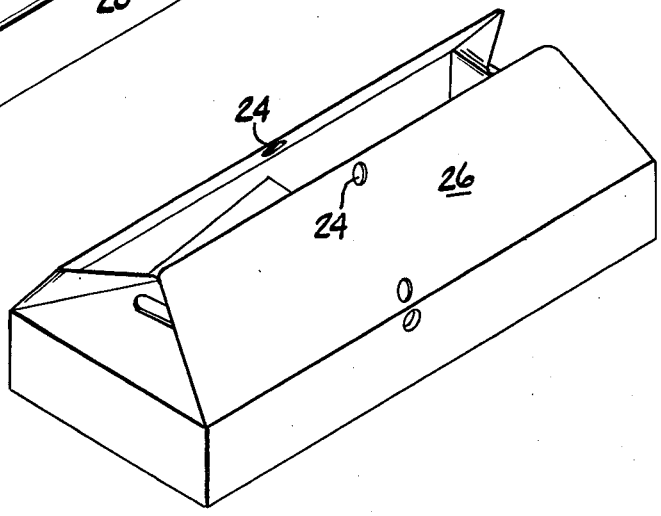
FIG. 3 is a perspective view of the one-piece body of the applicants' new and novel shipping container showing the bellows style top portion partially unfolded as the container would appear whenever it is being opened from the first compact use position to the second expanded use position.

The one-piece body 12 also has formed therein a plurality of lifting holes 24 which may be used for lifting the side panels 26 and 28 as shown in FIG. 3 of the drawing whenever the container 10 is repositioned from the first compact use position shown in FIGS. 1–3 to the second expanded use position as shown in FIG. 4 of the drawing. In the second expanded use position, the holes 24 may also be used with banding straps positioned through the top cap holes 16 and 18.

When the container is folded from the first compact use position as shown in FIG. 3 to the second expanded use position shown in FIG. 4, the inner end panels 36 and 40 would be repositioned by folding them in the direction of arrows 114 and 116 to lie in juxtaposition to the outer end panels 44 and 48. When the container is folded from the second expanded use position to the first compact use position, the inner end panels 36 and 40 would be refolded to lie in juxtaposition to the inner bottom panels 54 as shown in FIG. 5 of the drawings.

In order to more fully understand the folding of the applicants' container, there will now be described in detail, the production blank forming the container and then in order the folding sequence of the production blank and the various panels to obtain the set-up container.

Figures 5, 6:
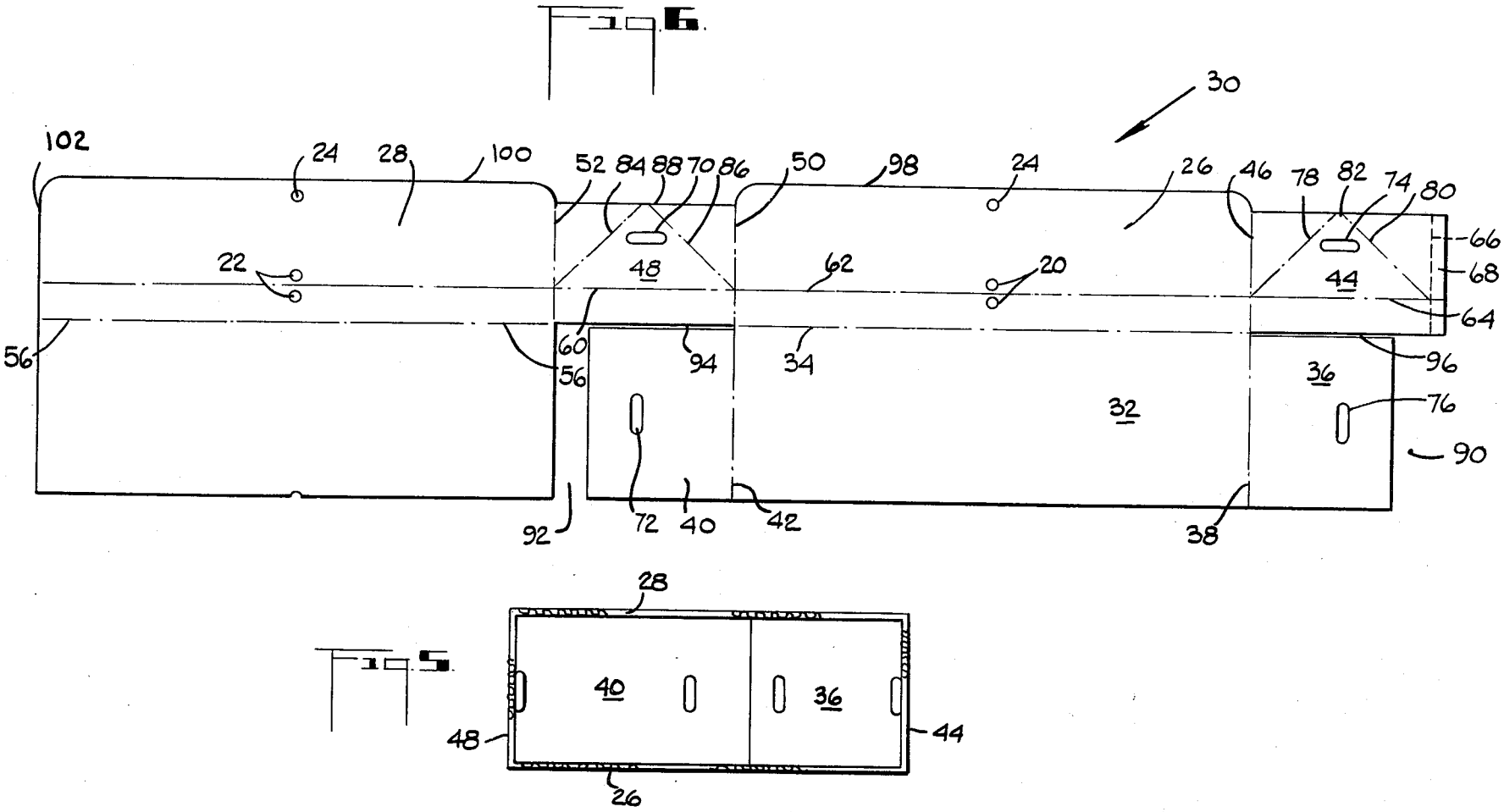
FIG. 5 is a plan view taken along lines 5—5 of FIG. 4 and showing the bellows style top portion completely opened up and further showing the position of the inner end panels lying in juxtaposition to the inner bottom panel as they would be positioned whenever the container is used in the first compact position.
FIG. 6 is a plan view of the one-piece production blank of the shipping container showing the respective positioning of the panels of the body.

Reference should now be made to FIG. 6 of the drawing which shows in detail the one-piece double depth shipping container body production blank shown generally by the numeral 30. The production blank 30 comprises an inner bottom panel 54 and an outer bottom panel 32 which are hingedly attached to their respective side panels 26 and 28 by means of score-lines 56 and 34. Positioned on one side of the outer bottom panel 32 is an inner end panel 36 hingedly attached thereto by means of a score-line 38. On the opposite side thereof, an inner end panel 40 is also hingedly attached to the outer bottom panel 32 by means of a score-line 42.

The side panel 26 has hingedly attached thereto on one side thereof an outer end panel 44 by means of a score-line 46. The side panel 26 also has hingedly attached thereto an outer end panel 48 by means of a score-line 50.

The outer end panel 48 is also hingedly attached to the side panel 28 by means of a score-line 52.

The side panel 28 is divided into two parts by means of an score-line 58 while the outer end panel 48 is divided into two parts by means of a score-line 60 as shown in the drawing FIG. 6. In a like manner, the side panel 26 is divided into two parts by means of a score-line 62 while the outer end panel 44 is divided into two parts by means of a score-line 64. The outer end panel 44 also has hingedly attached thereto, by means of a score-line 66, a hinged tab 68 forming a manufacturers joint for the production blank 30. It can be seen by referring to FIG. 6 of the drawing that the division of the side panels 26 and 28 as well as the outer end panels 44 and 48 and the tab 68 into two parts is made by the combination of the score-lines 58, 60, 62 and 64 which are in essence one continuous elongated score-line running the entire length of the production blank 30. These score-lines divide the side panels 26 and 28 as well as the outer end panel 44 and 48 and the tab 68 into the two parts which then determine the respective size of the shipping container whenever it is folded into the first compact use position or the second expanded use position.

The outer end panel 48 also has formed therein a hand hole 70 while the inner end panel 40 has formed therein a hand hole 72. In a like manner, the outer end panel 44 has formed therein a hand hole 74 while the inner end panel 36 has formed therein a hand hole 76. The hand holes 70 and 72 are positioned in the respective outer end panel 48 and the inner end panel 40 in such a manner as to be in juxtaposition whenever these panels are folded together as will be seen when referring to the other figures of the drawing. In a like manner, the hand holes 74 and 76 are positioned in their respective outer end panel 44 and inner end panel 36 in such a manner as to also be in juxtaposition to each other when these panels are folded together.

There is also formed in the outer end panel 44 a V-shaped score-line in the form of a pair of score-lines 78 and 80 which initiate at the apex of the V at a point approximately mid-way in the outer end panel 44 and located at the outer edge 82 thereof. The score-lines 78 and 80 terminate at the score-line 64.

In a similar manner the outer end panel 48 has formed therein a V-shaped score-line in the form of a pair of score-lines 84 and 86 which initiate at the apex of the V at a point approximately mid-way in the outer end panel 48 and located at the outer edge 88 and terminate at the score-line 60. The V-shaped score-lines formed in the outer end panel 44 and the outer end panel 48 form a bellows style top portion on the container which allows the container to be easily set up from either the first compact use position or the second expanded use position.

The inner end panel 36 is cut somewhat shorter than its adjacent outer end panel 44 as shown in FIG. 6 of the drawing leaving a recess 90 and in a similar manner the inner end panel 40 is cut somewhat shorter than its adjacent outer end panel 48 leaving a slot 92. In addition the inner end panel 40 is separated from its adjacent outer end panel 48 by means of the slot 94 while the inner end panel 36 is separated from its adjacent outer end panel 44 by means of the slot 96. In addition the outer edge 82 of the outer end panel 44 as well as the outer edge 88 of the outer end panel 48 is cut shorter than the outer edge 98 of the side panel 26 and the outer edge 100 of the side panel 28.

When the production blank 30 is formed as before described, the various panels will fit together and be able to be folded in the manner shown in various figures of the drawing in order to erect the one-piece container body 12.

Referring now to FIG. 7 of the drawings there is shown a plan view of the blank shown in FIG. 6 of the drawing as it is being formed into the set-up container. FIG. 7 shows the formation of the manufacturers joint which is formed by glueing or sewing the tab 68 to the underside of the side panel 28. In this position, the outer end panel 44 is pivoted about the score-line 46 and the inner bottom panel 54 along with the side panel 28 would be repositioned by pivoting them about the score-line 52 to lie in juxtaposition to the outer end panel 44.

Reference should now be made to FIGS. 8–13 in order to understand the completed folding sequence of the applicant's container. After the production blank of FIG. 6 has been folded to the position shown in FIG. 7 with the manufacturers joint being formed, the container would be opened as shown in FIG. 8 of the drawing. FIG. 8 is a perspective view looking at the bottom of the applicant's container. The inner end panel 36 would be folded about the score-line 38 as shown by the arrow 106. In a similar manner, the inner end panel 40 would be folded about the score-line 42 as shown by the arrow 108. In addition, the inner bottom panel 54 would be folded about the score-line 56 in the direction shown by the arrow 104.

By referring to FIG. 9 there can be seen the next folding sequence in the applicant's invention. FIG. 9 is also a perspective view looking at the bottom of the applicant's container. The inner bottom panel 54 is folded inside the opened container and the inner end panels 36 and 40, which now lie in juxtaposition with the outer bottom panel 32, are folded in the direction shown by the arrow 112 to lie in juxtaposition with the folded inner bottom panel 54. By referring now to FIG. 10 this last described folding position can be seen looking from the top of the container. The inner bottom panel 54 is lying inside the container with the folded inner end panels 36 and 40 along with the outer bottom panel being positioned underneath. In this position, as shown in FIG. 10, the bottom of the container is still not completely formed but requires the additional folding steps as shown in FIGS. 11 to 13. In FIG. 11, the inner bottom panel 54 has been folded upwardly to lie in juxtaposition to the side panel 28 thereby exposing the inner end panels 36 and 40.

FIG. 12 shows the next folding step where the inner end panels 36 and 40 have been folded upwardly to lie in juxtaposition with the outer end panels 44 and 48 respectively. Thereafter the inner bottom panel 54 is folded downwardly to lie in juxtaposition to the outer bottom panel 32. The inner end panels 36 and 40 are now free to be positioned in the appropriate position for the applicant's container depending on whether the container is used in the first compact use position shown in FIG. 3 or the second expanded use position shown in FIG. 4.

Figure 14:
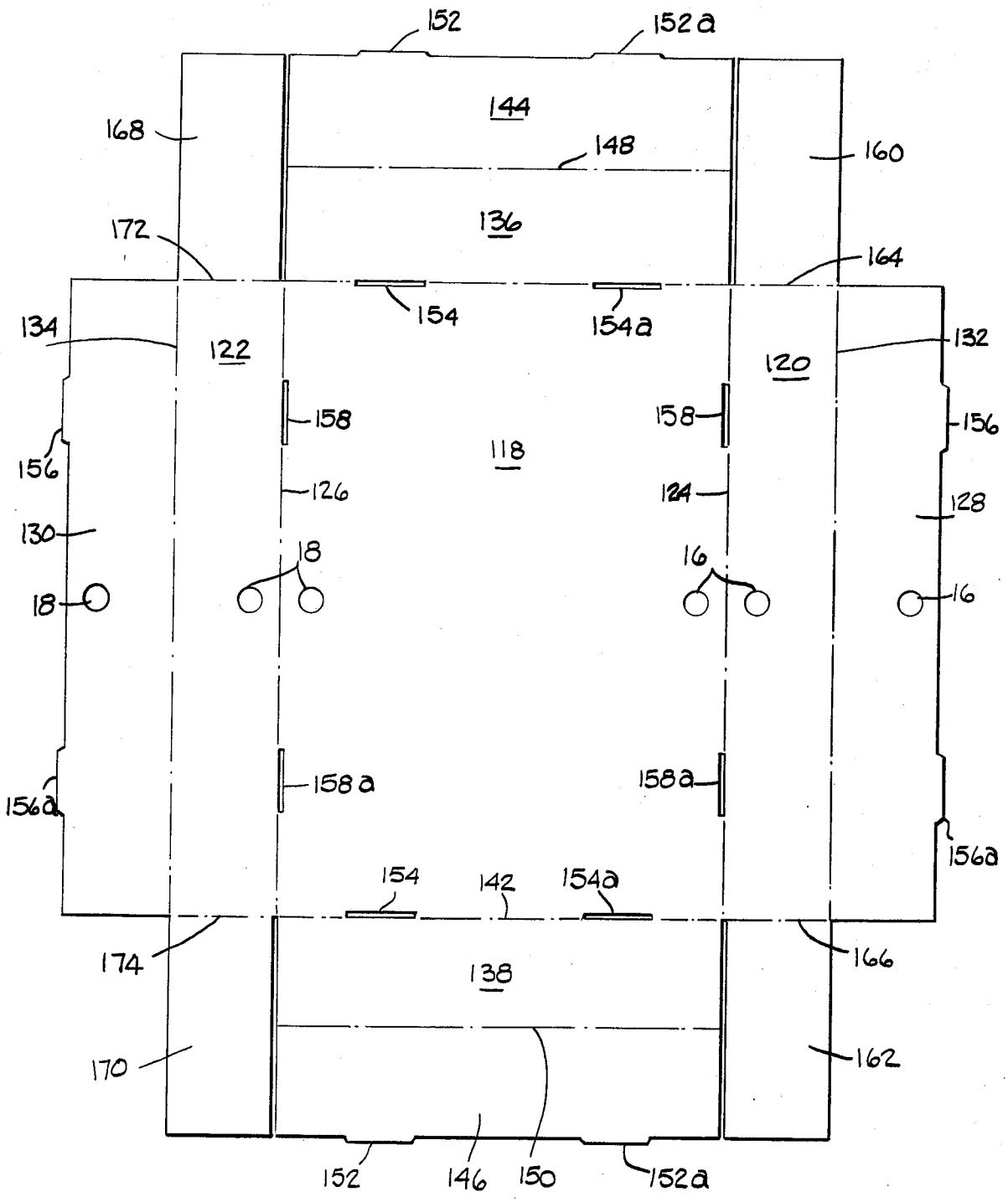
FIG. 14 is a plan view of the standard top cap that may be utilized with the applicants' container.

Reference should now be made to FIG. 14 of the drawing which is a plan view of a standard top cap 14 which may be utilized with the applicant's container body. A central panel 118 is hingedly connected to a pair of side panels 120 and 122 by means of the score lines 124 and 126. The side panels 120 and 122 are also hingedly connected to a pair of side panels 128 and 130 by means of the score lines 132 and 134. In a similar manner, the central panel 118 is hingedly connected to a pair of end panels 136 and 138 by means of the score-lines 140 and 142. The end panels 136 and 138 are also hingedly connected to end panels 144 and 146 by means of score-lines 148 and 150.

The end panels 144 and 146 have formed thereon tabs 152 and 152*a* designed to engage in matching slots 154 and 154*a* formed along the score-lines 140 and 142. In a similar manner, the side panels 128 and 130 have formed thereon tabs 156 and 156*a* designed to engage in matching slots 158 and 158*a* formed along the score-lines 124 and 126. The side panel 120 has hingedly attached thereto a pair of flaps 160 and 162 by means of the score-lines 164 and 166. The side panel 122 has hingedly attached thereto a pair of flaps 168 and 170 by means of the score-lines 172 and 174.

In erecting the top cap production blank of FIG. 14 into the top cap 14 shown in FIGS. 1 and 2, the side panels 120 and 128 would be folded about the score-lines 132 and 124 so that the tabs 156 and 156*a* would be inserted into the slots 158 and 158*a*. In a similar manner the side panels 130 and 122 would be folded about the score-lines 134 and 126 so that their tabs 156 and 156*a* would also be inserted into their slots 158 and 158*a*. Next in sequence, the flaps 160, 162, 168 and 170 would be folded about their respective score lines 164, 166, 172 and 174 to lie in juxtaposition to their respective end panels 130 and 138. The end panels 144 and 136 would then be folded about the score-lines 148 and 140 so that the flaps 160 and 168 were positioned therebetween. The tabs 152 and 152*a* would then be inserted into the slots 154 and 154*a*. In a similar manner the flaps 170 and 162 would be folded to be positioned between the end panels 138 and 146 so that their respective tabs 152 and 152*a* could be inserted into their slots 154 and 154*a*.

From the foregoing it can be seen that there has been provided a new and novel one-piece shipping container that may be folded to two usable positions, either a first compact position or a second expanded use position. While many changes can be made in the arrangement of the various parts of the container, the applicant's invention is not to be limited to the embodiment shown and described which has been shown and described by way of illustration only.

Having described our invention, we claim:

1. A one-piece double depth shipping container body production blank, comprising:

(a) a pair of side panels;

(b) an outer bottom panel hingedly attached to one of the side panels by a first score-line;

(c) a pair of inner end panels hingedly attached to the outer bottom panel by a second and third score-line;

(d) a pair of outer end panels hingedly attached to one of the side panels by a fourth and fifth score-line;

(1) one of the outer end panels also being hingedly attached to the other side panel by a sixth score-line;

(e) an inner bottom panel hingedly attached to the other side panel by a seventh score-line;

(f) the pair of side panels and the pair of outer end panels having formed therein an elongated eighth score-line spaced a pre-determined distance from the first and seventh score-line, the elongated eighth score-line running along the two side panels and the two outer end panels;

(g) one of the outer end panels also having formed thereon a hinged tab forming a manufacturers joint for the blank whenever the blank is set up into a container, the hinge being formed from a ninth score-line formed perpendicular to the eighth score-line; and (h) each of the outer end panels also having formed therein a generally V-shaped score-line formed by a tenth and eleventh score-line and initiating at the apex of the V at a point approximately midway in the panel and located at an outer edge thereof and terminating at the elongated eighth score-line.

2. The production blank as defined in claim 1 further comprising the outer end panels and the inner end panels having formed therein hand holes.

3. The production blank as defined in claim 1 further comprising the side panels having formed therein at least three banding holes.

4. A one-piece double depth shipping container body, foldable to either a first compact use position or to a second expanded use position, comprising:

(a) a pair of side panels;

(b) a pair of outer end panels hingedly attached to the pair of side panels;

(c) an outer bottom panel hingedly attached to one of the side panels;

(d) an inner bottom panel hingedly attached to the other of the side panels;

(e) a pair of inner end panels hingedly attached to the outer bottom panel;

(f) score-line means, associated with the pair of side panels and the pair of end panels, for folding the respective side and end panels from the first compact use position to the second expanded use position whenever desired;

(g) the inner and outer bottom panels being in juxtaposition whenever the container is erected and utilized in the first compact use position and in the second expanded use position; and (h) the inner and outer end panels being folded upwardly and in juxtaposition whenever the container is erected in the second extended use position and further the inner end panels also being folded downwardly and in juxtaposition with the inner bottom panel whenever the container is erected in the first compact use position.

5. The shipping container as defined in claim 4 wherein the score-line folding means comprises in part an elongated score-line being formed in the pair of side panels and also in the pair of end panels and further comprises in part V-shaped score-lines being formed in each of the pair of outer end panels.

6. The shipping container as defined in claim 5 wherein the side panels have formed therein at least three banding holes.

7. The shipping container as defined in claim 6 wherein the inner and outer end panels have formed therein hand holes lying in juxtaposition to each other when the container is in the second extended position.

8. The shipping container as defined in claim 4 further comprising the container having positioned thereon a top cap.

9. The shipping container as defined in claim 6 further comprising the container having positioned thereon a top cap and further comprising the top cap having formed therein a plurality of banding holes which are positioned in juxtaposition to the banding holes formed in the side panels.

* * * * *